US008820848B2

(12) United States Patent
Rötsch et al.

(10) Patent No.: US 8,820,848 B2
(45) Date of Patent: Sep. 2, 2014

(54) MILLING ROTOR FOR PROCESSING GROUND MATERIAL AND A GROUND MILLING MACHINE HAVING SUCH A ROTOR

(75) Inventors: Helmut Rötsch, Beltheim (DE); Hans Forster, Sabershausen (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 13/564,328

(22) Filed: Aug. 1, 2012

(65) Prior Publication Data

US 2013/0033091 A1 Feb. 7, 2013

(30) Foreign Application Priority Data

Aug. 4, 2011 (DE) ..... 10 2011 109 450

(51) Int. Cl.

| | |
|---|---|
| ***E01C 23/088*** | (2006.01) |
| ***E01C 23/12*** | (2006.01) |
| ***B28D 1/18*** | (2006.01) |
| *E21C 27/24* | (2006.01) |

(52) U.S. Cl.

CPC ..... *E01C 23/088* (2013.01); *E21C 27/24* (2013.01); *E01C 23/127* (2013.01); *B28D 1/186* (2013.01)

USPC ..... 299/39.4; 299/87.1

(58) Field of Classification Search

USPC ..... 299/39.1, 39.4, 39.8, 78, 87.1, 102, 299/106, 108

See application file for complete search history.

(56) References Cited

U.S. PATENT DOCUMENTS

| | | | | |
|---|---|---|---|---|
| 1,148,975 | A * | 8/1915 | Kuhn et al. | 299/77 |
| 4,697,850 | A * | 10/1987 | Tuneblom | 299/87.1 |
| 5,775,781 | A * | 7/1998 | Sawtelle et al. | 299/39.8 |
| 5,864,970 | A * | 2/1999 | Maddock et al. | 37/94 |
| 6,948,779 | B2 * | 9/2005 | Ehler et al. | 299/39.4 |
| 7,290,360 | B2 * | 11/2007 | Unzicker et al. | 37/352 |
| 7,547,074 | B2 * | 6/2009 | Beach et al. | 299/79.1 |
| 2006/0243466 | A1 * | 11/2006 | Beller et al. | 172/518 |
| 2006/0255649 | A1 * | 11/2006 | Dawood | 299/87.1 |

* cited by examiner

*Primary Examiner* — David Bagnell
*Assistant Examiner* — Michael Goodwin
(74) *Attorney, Agent, or Firm* — Wood, Herron & Evans, LLP

(57) ABSTRACT

The present invention relates to a milling rotor for processing ground material, comprising a plurality of milling tools which are arranged in a distributed manner over the jacket surface spaced at predetermined distances and according to a predetermined pattern. In order to improve the distribution of the milling material, the milling tools are arranged in the circumferential direction of the milling rotor along parallel imaginary lines which are composed of at least one respective, equally long section of a left-hand and a right-hand helical line.

14 Claims, 4 Drawing Sheets

MILLING ROTOR FOR PROCESSING GROUND MATERIAL AND A GROUND MILLING MACHINE HAVING SUCH A ROTOR

CROSS-REFERENCE TO RELATED APPLICATIONS

The present application claims priority under 35 U.S.C. §119 of German Patent Application No. 10 2011 109 450.8, filed Aug. 4, 2011, the disclosure of which is hereby incorporated herein by reference in its entirety.

FIELD OF THE INVENTION

The present invention relates to a milling rotor for processing ground material, having a plurality of milling tools which are arranged in a distributed manner over the jacket surface spaced at predetermined distances and according to a predetermined pattern.

BACKGROUND OF THE INVENTION

In the road construction industry, ground milling machines in form of road milling machines, stabilizers and recyclers are used which comprise a milling rotor. The milling rotor consists of a cylindrical tube, on the jacket surface of which the milling tools are arranged. Chisels or chisel-like apparatuses which are either welded directly onto the rotor or held in quick-change tool holders are used as milling tools.

Ground milling machines of the generic kind are used for tearing open the respective surfaces over a wide area and in a continuous fashion, such as during the reconstruction of roads and paths, and for re-using the milling material subsequently for the production of a new base course. In the case of stabilizers and recyclers, stabilizing agents and so-called secondary raw materials and further building materials such as sand and the like are optionally mixed into the milling material within the rotor box in a continuous manner. They will be mixed with the detached milling material by a rotation of the milling drum in the rotor box. The mixture will remain locally as a relatively flat layer for further processing. The detached milling material and the mixture of detached milling material and aggregates will be referred to below simply as milling material.

In known milling rotors, the milling tools are distributed on the rotor jacket in the manner that—as seen in the circumferential direction—a pattern with a V-like or W-like progression is produced which is symmetrical to the central line. It has been found, however, that depending on the milling depth, the rotor speed and the travelling speed of the ground milling machine, the milling material will be conveyed towards the center of the rotor or on both sides to the outside, and will be deposited in an inhomogeneous manner. Coarse fractions in particular form undesirable accumulations in the center of the milling track.

SUMMARY OF THE INVENTION

The present invention is therefore based on the object of providing a milling rotor of the kind described above and a ground milling machine having such a rotor with which the distribution of the milling material is improved.

This object is achieved in such a way that the milling tools are arranged in the circumferential direction of the milling rotor along imaginary lines which extend in parallel and are composed of at least one respective, equally long section of a left-handed and a right-handed helical line.

The present invention offers the advantage that, as a result of the arrangement of the milling tools, there will not be any scooping effect and therefore no undesirable displacement and accumulation of the milling material by the milling tools. The arrangement of the milling tools in accordance with the present invention does not form any pattern causing a division within the jacket surface along the circumference, and no division towards the center of the rotor. The milling material rather remains approximately on the milling line when the rotor has turned once and forms a flat surface with homogeneous distribution.

BRIEF DESCRIPTION OF THE DRAWINGS

The present invention will be explained below in closer detail by reference to an embodiment shown in the schematic drawings, wherein.

DETAILED DESCRIPTION OF THE INVENTION

Figure 1:
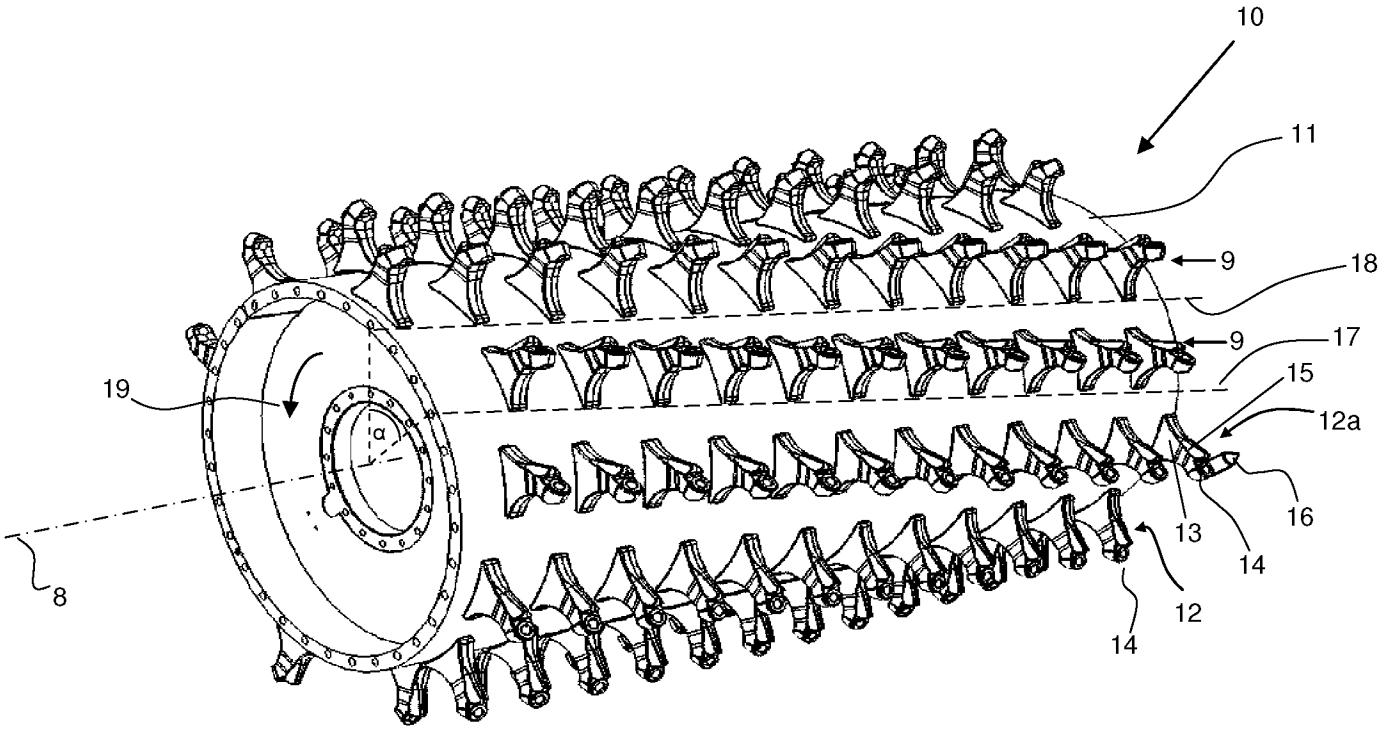
FIG. 1 shows a perspective view of a milling rotor.
Figure 2:
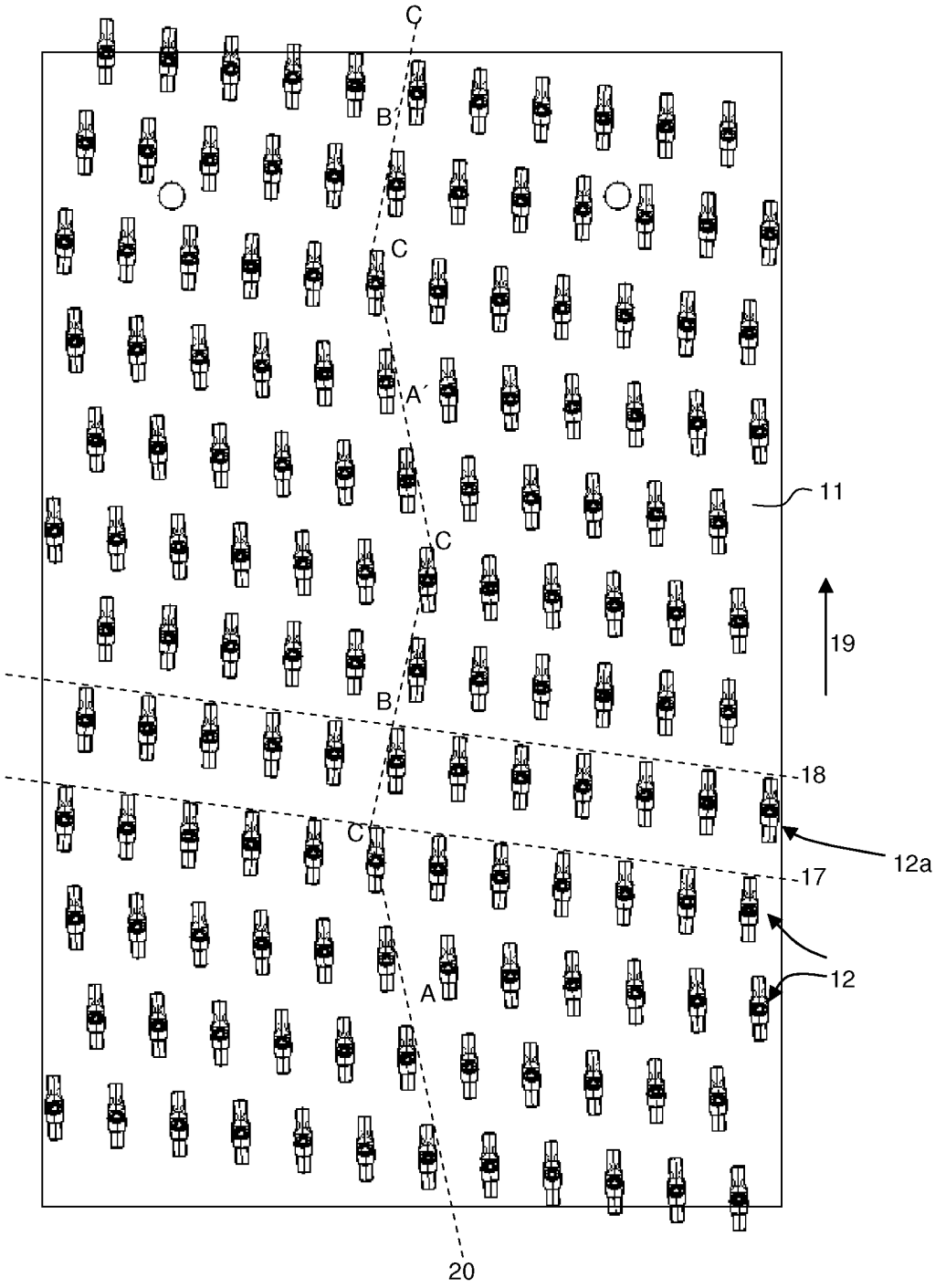
FIG. 2 shows a top developed view of the cylinder jacket of the milling rotor according to FIG. 1.

In accordance with FIGS. 1 and 2, a circular-cylindrical milling rotor 10 of a ground milling machine (not shown) comprises a jacket surface 11, on which a plurality of milling tools 12 are attached. The rotor axis is designated with reference numeral 8. A component is designated here as a milling tool which consists of a chisel holder 13 with a chisel receptacle 14, a clod breaker 15 and a chisel 16 which is only shown on a single milling tool 12*a*. The milling tools 12 are arranged in lines 9 which extend along parallel dot-dash lines 17, 18 and which extend over the entire width of the milling rotor 10. The lines 9 are disposed at the same angular distance a from one another and the milling tools 12 have the same lateral distance from one another within one line. From a spatial point of view, the lines 17, 18 concern sections of helical lines with a first, relatively large ascending gradient. The direction of rotation of the milling rotor 10 is illustrated with arrow 19.

Figure 3:
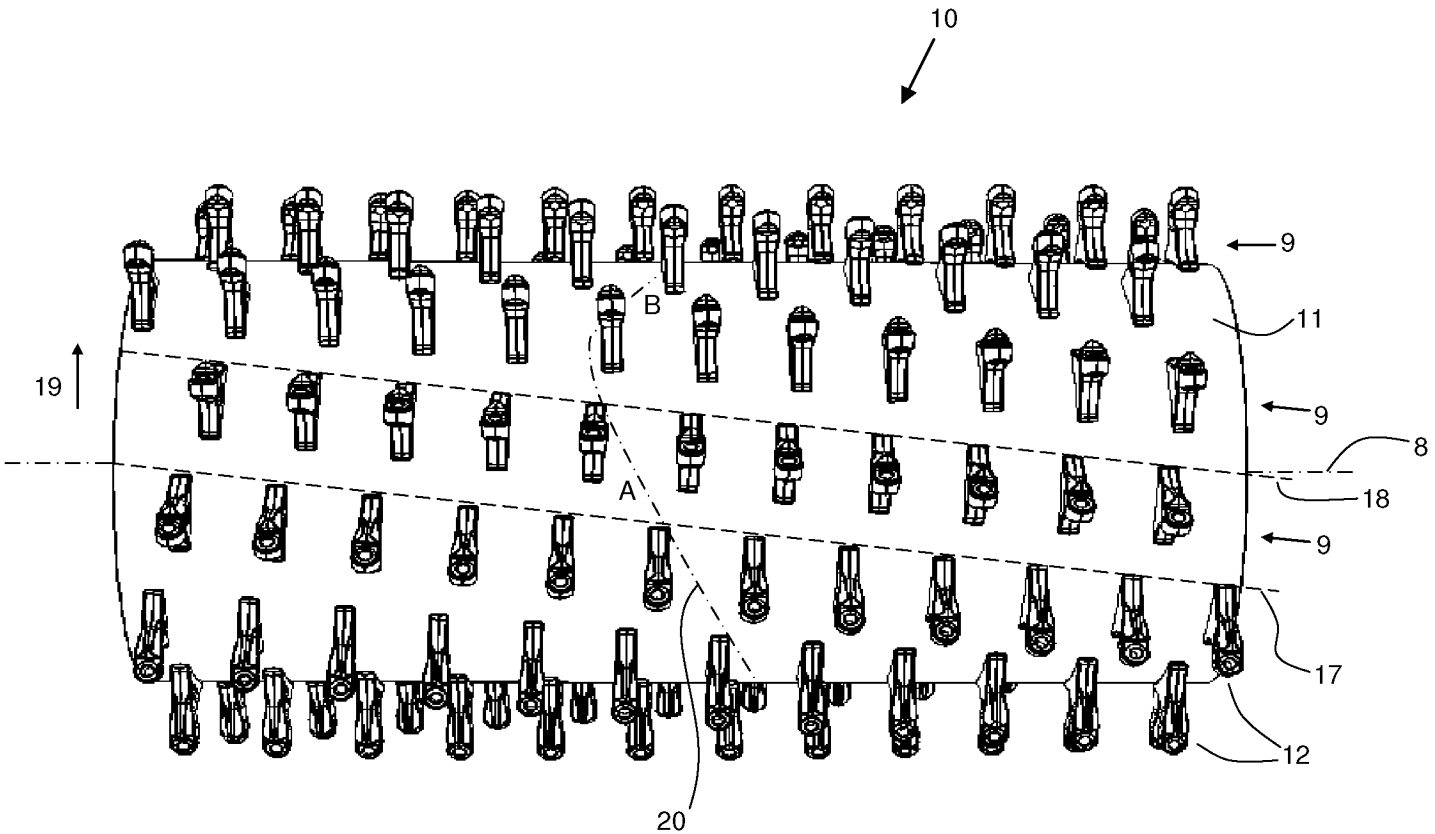
FIG. 3 shows a side view of the milling rotor of FIG. 1.

As is shown in FIG. 2 in conjunction with FIG. 3, the milling tools 12 are further arranged in the circumferential direction along imaginary further lines 20 which in a developed view of the jacket surface 11 in accordance with FIG. 2 are shown as a zigzag line with four equally long, alternating sections A, B and A', B' and four direction changes C. In order to ensure clarity of the illustration, only one of these lines 20 is shown. The number n of the direction changes C along the further lines 20 therefore has an even number. From a spatial point of view, this concerns four alternating sections of left-hand and right-hand second and third helical lines with a second ascending gradient. The second ascending gradient is identical in the second and third helical line. It is much shorter in comparison with the first helical line. The arrangement of the milling tools 12 is repeated after half a jacket length, i.e., it is similar on each half of the milling rotor 10. FIG. 3 shows the first section A of a right-hand helical line and the first section B of a left-hand helical line, as shown in a view on one side of the milling rotor 10. Each section A, B and A', B' has the same number of milling tools 12. As an example, three milling tools 12 are respectively disposed along the line 20 in each of sections A, B and A', B'.

Figure 4:
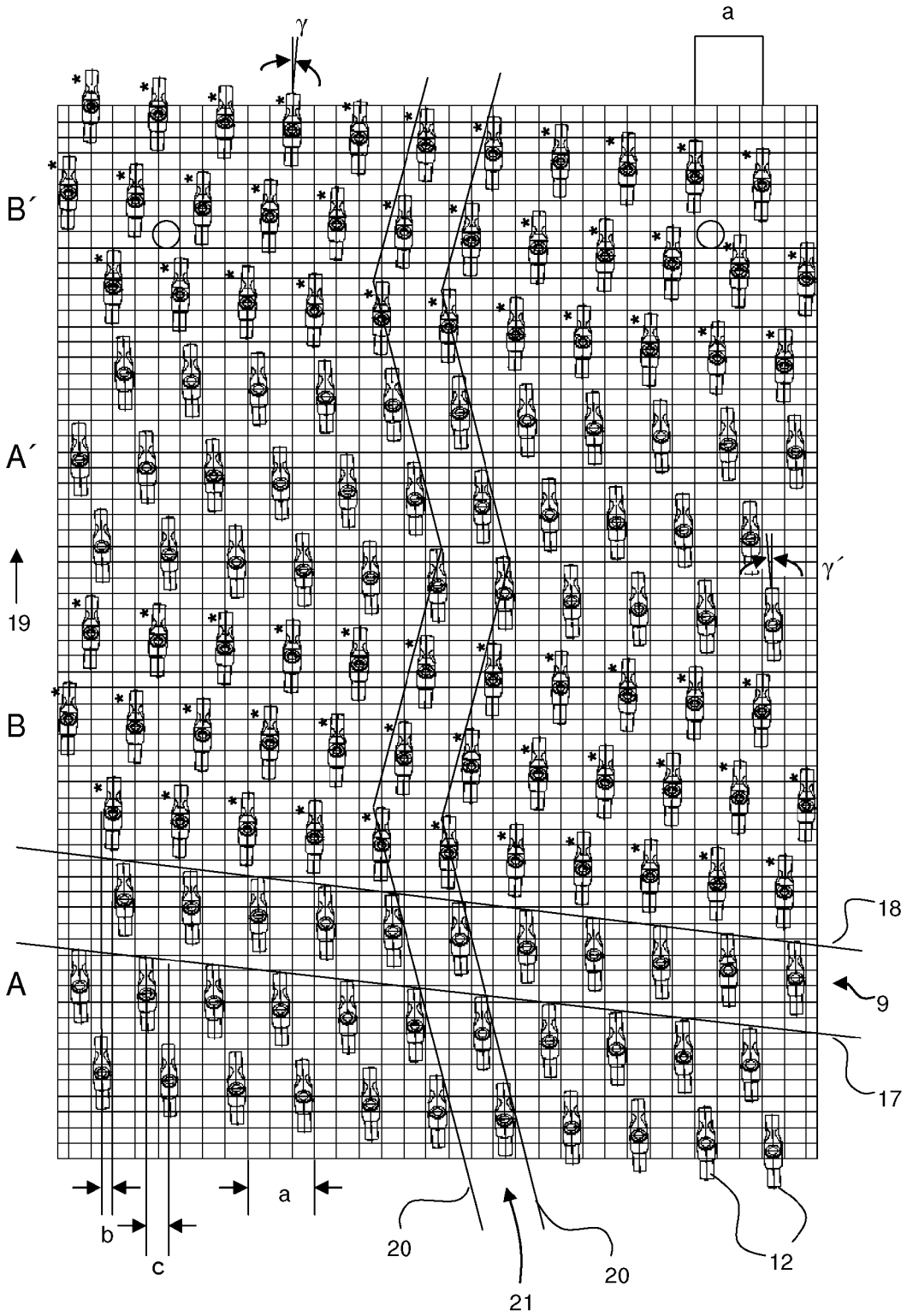
FIG. 4 shows a top developed view of the cylinder jacket according to FIG. 2 with auxiliary lines.

In order to provide more clarity as to the arrangement of the milling tools 12 on the jacket surface 11, the developed view of the jacket surface 11 according to FIG. 4 shows auxiliary lines in the form of a rectangular grid. Furthermore, the left-hand helical lines of the sections B and B' are additionally labeled with an (*) for visually illustrating the arrangement in the figure. In all other respects, FIG. 4 corresponds to the illustration of FIG. 2. The grid of the auxiliary lines shows that the milling tools 12 which are arranged in one line 9 are arranged with a first lateral offset a to each other within the line 9. Furthermore, the milling tools which are arranged on further imaginary lines 20 in the circumferential direction are arranged in interstices, i.e., in the circumferential direction at least one other milling tool 12 is arranged at least in a partly lateral overlapping manner between two adjacent milling tools 12 or in a gap that is formed by two adjacent milling tools 12. In the illustrated example, the milling tools 12 are arranged along the lines 20 within each section A, B and A', B' with the predetermined third lateral offset c. The milling tools 12 in sections of the line 20 with opposing helical lines, i.e., sections A, A' on the one hand and sections B, B' on the other hand, are further arranged in sections by the second lateral offset b in the manner that the milling tools 12 of the sections with opposing helical lines A, B and A', B' overlap partly by the second lateral offset b, as seen in the circumferential direction. Two further milling tools 12 are therefore disposed along the line 20 in connection with each milling tool 12, which further milling tools are arranged in a partly overlapping manner by the second lateral offset b. The second lateral offset b is smaller than the first lateral offset a. In the illustrated example, the first offset a corresponds approximately to the width of three milling tools 12 and the second offset b approximately to half the width of the milling tool 12.

A respective channel 21 on either side of the lines 20 is obtained between the milling tools 12 of two adjacent lines 20 by the first lateral offset a, which channel has the same width as the first offset a. These channels 21 are free from milling tools 12 and extend along the entire circumference of the milling rotor 10. Their progression corresponds to the progression of the lines 20. Material detached by the milling tools 12 and optionally admixed material therefore reaches the adjacent channels 21 on both sides of the milling tools 12 on the lines 20. The material is therefore merely provided with a lateral deflection which is not larger than the channel width or the first lateral offset a. The material processed by the milling tools 12 on two adjacent lines 20 reaches the channels 21 in the described manner.

Milling tools 12 are provided having two different angular positions relative to the rotor axis 8. One part of the milling tools is arranged with an angular orientation directed to the left with an angle γ on the one rotor edge and an equally large part is arranged with an angular orientation directed to the right with an angle γ' on the other rotor edge. The angles γ and γ' are equally large and mirrored on a circumferential line. They are disposed in the range of approximately 2° to 3°. The milling tools 12 with the one angular position are disposed on the sections A, A' of the lines 20, which corresponds to the one helical line. The milling tools 12 with the other angular position are disposed on the sections B, B'; the milling tools 12 on the sections with the left-hand helical line all have the same angular position and the milling tools 12 with the mirrored angular position are all disposed on the sections with the right-hand helical line. Furthermore, all milling tools on a line 9 respectively have the same angular position.

The milling tools 12 are subdivided into equally large groups. Each group comprises the milling tools 12 which are arranged within one of the sections A, B, A' and B'. It is therefore determined by a number m of the associated lines 9. All milling tools 12 within one group further respectively have the same angular position of the milling tools 12. The number of such groups is even. A total of four groups are provided in the illustrated example, with groups with milling tools 12 with opposing angular positions alternating along the jacket surface 11 in the direction of rotation.

As a result of the angular position of the milling tools 12, a wedge surface acting against the direction of rotation of the milling rotor 10 will be produced in each milling tool 12 especially by the chisel holders 13 and the clod breakers 15, because the milling tools 12 form a body by the chisel holders 13 and the clod breakers 15, which body is aligned with its longitudinal axis in an oblique manner in relation to the direction of rotation. The wedge surfaces produce a lateral deflection of detached or admixed material, which is also supported by the chisel tips because the chisels 16, together with the chisel holders 13, are likewise aligned in an angular fashion.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A milling rotor for processing ground material, comprising:

a rotor axis and a plurality of milling tools which are arranged in a distributed manner over the jacket surface spaced at predetermined distances and according to a predetermined pattern, wherein the milling tools are arranged along imaginary lines which extend in parallel in the circumferential direction of the milling rotor and are composed of at least one section (A, B; A', B') of a left-handed and a right-handed helical line, wherein the sections (A, B; A', B') are equally long, and further wherein the imaginary lines extend along the entire circumference of the milling rotor.

2. A milling rotor according to claim 1, wherein the milling tools on the imaginary lines are arranged so that in the circumferential direction at least one milling tool in a section (A, B; A', B') is arranged in a gap that is formed by two adjacent milling tools in another section (A, B; A', B') on the imaginary lines.

3. A milling rotor according to claim 1, wherein the milling tools of the at least one section (A, A') of the right-handed and left-handed helical lines are arranged as seen in the circumferential direction in a partly overlapping manner with the milling tools of the respectively other section (B, B').

4. A milling rotor according to claim 1, wherein the imaginary lines comprise two sections (A, B; A', B') of the left-handed and right-handed helical lines in an alternating manner.

5. A milling rotor according to claim 1, wherein adjacent imaginary lines are arranged in such a way that a partial overlapping of at least one milling tool on the one imaginary line is obtained in the circumferential direction with at least one milling tool on the other imaginary line.

6. A milling rotor according to claim 1, wherein several milling tools are arranged within each section (A, B; A', B')

behind one another on the imaginary line, and that each section (A, B; A', B') has the same number of milling tools.

7. A milling rotor according to claim 1, wherein the longitudinal axes of the milling tools are aligned with predetermined angular orientations (y, y') with respect to the direction of rotation, with a part of the milling tools having a first angular orientation (y') directed towards one rotor edge and another part of the milling tools having a mirrored angular orientation (y) directed to the opposite rotor edge, and with the milling tools with the first angular orientation (y') being arranged on the right-handed helical line and the milling tools with the mirrored angular orientation (y) being arranged on the left-handed helical line.

8. A milling rotor according to claim 1, wherein the milling tools are arranged in mutually spaced oblique lines which extend in one direction obliquely to the rotor axis and which extend over the entire rotor width, with each oblique line being spaced from an adjacent oblique line by a predetermined angular distance (a) measured from the rotor axis.

9. A milling rotor according to claim 8, wherein the milling tools of one oblique line have the same angular orientation (y, y'), and that oblique lines with the first angular orientation (y') and oblique lines with the mirrored angular orientation (y) follow one another in the circumferential direction, with the number (n) of the changes in the angular orientation (y, y') along the entire jacket surface in the direction of rotation having an even number (n=2, 4, . . . ).

10. A milling rotor according to claim 8, wherein the oblique lines extend on the rotor jacket along a section of a further helical line.

11. A milling rotor according to claim 8, wherein groups of successive oblique lines with milling tools of the same angular orientation (y, y') are provided in an alternating manner, with the groups respectively having the same number of lines (m).

12. A milling rotor according to claim 11, wherein the lateral offset of milling tools of adjacent oblique lines within the groups is arranged as a third offset (c), and that a second lateral offset (b) is provided between the milling tools of adjacent oblique lines of two adjacent groups which is smaller than both the first offset (a) and the third offset (c).

13. A ground milling machine having a milling rotor according to claim 1.

14. A ground milling machine according to claim 13, wherein the ground milling machine is a recycler or stabilizer.

* * * * *